US011102569B2

(12) United States Patent
Okuda

(10) Patent No.: US 11,102,569 B2
(45) Date of Patent: Aug. 24, 2021

(54) METHODS AND APPARATUS FOR A MICROPHONE SYSTEM

(71) Applicant: SEMICONDUCTOR COMPONENTS INDUSTRIES, LLC, Phoenix, AZ (US)

(72) Inventor: Kozo Okuda, Hirakata (JP)

(73) Assignee: SEMICONDUCTOR COMPONENTS INDUSTRIES, LLC, Phoenix, AZ (US)

( * ) Notice: Subject to any disclaimer, the term of this patent is extended or adjusted under 35 U.S.C. 154(b) by 0 days.

(21) Appl. No.: 16/225,810

(22) Filed: Dec. 19, 2018

(65) Prior Publication Data

US 2019/0230433 A1 Jul. 25, 2019

Related U.S. Application Data

(60) Provisional application No. 62/620,707, filed on Jan. 23, 2018.

(51) Int. Cl.

| | |
|---|---|
| ***H04R 1/22*** | (2006.01) |
| ***H04R 1/04*** | (2006.01) |
| ***H04R 3/04*** | (2006.01) |
| ***H04R 3/00*** | (2006.01) |

(52) U.S. Cl.

CPC ..... *H04R 1/222* (2013.01); *H04R 1/04* (2013.01); *H04R 3/00* (2013.01); *H04R 3/04* (2013.01); *H04R 3/005* (2013.01); *H04R 2410/07* (2013.01); *H04R 2430/03* (2013.01)

(58) Field of Classification Search

CPC . H04R 1/222; H04R 1/04; H04R 3/04; H04R 2410/07; H04R 2410/05

USPC ..... 381/177, 71.1, 94.1

See application file for complete search history.

(56) References Cited

U.S. PATENT DOCUMENTS

| | | | | |
|---|---|---|---|---|
| 5,426,719 | A * | 6/1995 | Franks | H04R 1/1083 381/72 |
| 8,194,881 | B2 * | 6/2012 | Haulick | G10L 21/0208 381/122 |
| 2009/0123009 | A1 | 5/2009 | Roeck | |
| 2013/0243214 | A1 * | 9/2013 | Penketh | G10K 11/175 381/71.6 |
| 2014/0079245 | A1 * | 3/2014 | Maruko | H04R 3/005 381/94.7 |
| 2015/0063590 | A1 * | 3/2015 | Katagiri | H04R 3/005 381/92 |
| 2015/0213811 | A1 * | 7/2015 | Elko | H04R 25/453 381/92 |

(Continued)

*Primary Examiner* — Ahmad F. Matar
*Assistant Examiner* — Sabrina Diaz
(74) *Attorney, Agent, or Firm* — Noblitt & Newson, PLLC; Gary W. Newson

(57) ABSTRACT

Various embodiments of the present technology comprise a method and apparatus for a microphone system. Various embodiments of the present technology may comprise a first microphone connected to a first high pass filter and a second microphone connected to a second high pass filter. The microphone system may further comprise a frequency controller configured to selectively activate the first high pass filter and the second high pass filter according to detected wind noise. The first and second high pass filters may be arranged to filter sound data from the first and second microphone prior to processing the sound data using beamforming.

19 Claims, 7 Drawing Sheets

(56) References Cited

U.S. PATENT DOCUMENTS

| | | | | |
|---|---|---|---|---|
| 2015/0356964 | A1 | 12/2015 | Ono | |
| 2016/0133271 | A1 * | 5/2016 | Kuntzman | H03F 3/183<br>381/94.2 |

* cited by examiner

METHODS AND APPARATUS FOR A MICROPHONE SYSTEM

CROSS-REFERENCE TO RELATED APPLICATION

This application claims the benefit of U.S. Provisional Patent Application Ser. No. 62/620,707, filed on Jan. 23, 2018, and incorporates the disclosure of the application by reference.

BACKGROUND OF THE TECHNOLOGY

Many microphone systems implement beamforming techniques to process and enhance sound data. In some environments, wind noise, which is generated by air flow across the microphone, introduces a noise component that degrades the target sound, in most cases speech. Conventional beamforming techniques, however, are not able to remove wind noise and in some cases even enhance wind noise. Conventional microphone systems have tried to address this problem by disabling the beamforming when wind noise is detected and enabling the beamforming when the wind noise is not detected. However, when the beamforming is disabled, the system is not able to process and enhance the target speech, which results in less desirable sound data.

SUMMARY OF THE INVENTION

Various embodiments of the present technology comprise methods and apparatus for a microphone system. Various embodiments of the present technology may comprise a first microphone connected to a first high pass filter and a second microphone connected to a second high pass filter. The microphone system may further comprise a frequency controller configured to selectively activate the first high pass filter and the second high pass filter according to detected wind noise. The first and second high pass filters may be arranged to filter sound data from the first and second microphone prior to processing the sound data using beamforming.

BRIEF DESCRIPTION OF THE DRAWING FIGURES

A more complete understanding of the present technology may be derived by referring to the detailed description when considered in connection with the following illustrative figures. In the following figures, like reference numbers refer to similar elements and steps throughout the figures.

Figure 13:
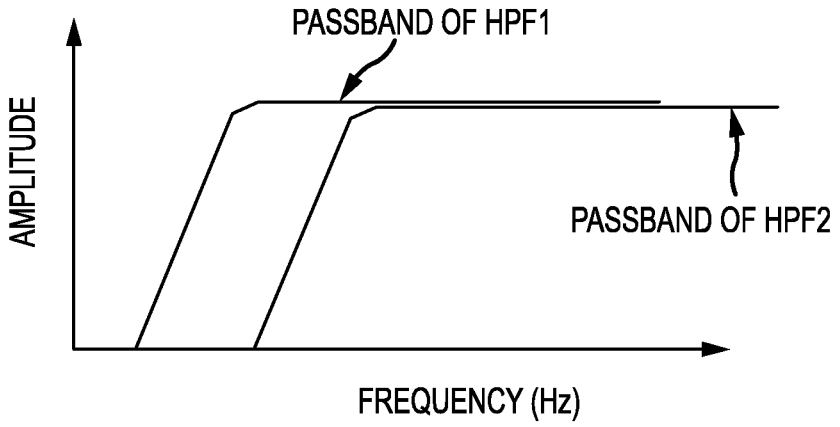
Figure 14:
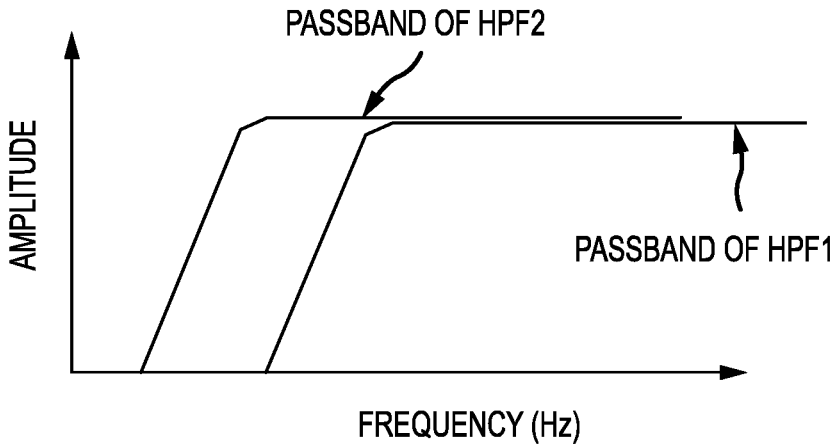

FIG. 13 is a frequency spectrum diagram illustrating the passband of the first high pass filter and the passband of the second high pass filter when the cutoff frequencies for the first high pass filter and the second high pass filter are not equal in accordance with various embodiments of the present technology; and FIG. 14 is a frequency spectrum diagram illustrating the passband of the first high pass filter and the passband of the second high pass filter when the cutoff frequencies for the first high pass filter and the second high pass filter are not equal in accordance with various embodiments of the present technology.

DETAILED DESCRIPTION OF EXEMPLARY EMBODIMENTS

The present technology may be described in terms of functional block components and various processing steps. Such functional blocks may be realized by any number of components configured to perform the specified functions and achieve the various results. For example, the present technology may employ various microphones, filters, delay circuits, beamforming methods, and the like, which may carry out a variety of functions. In addition, the present technology may be practiced in conjunction with any number of systems, such as automotive, aerospace, medical, scientific, surveillance, and consumer electronics, and the systems described are merely exemplary applications for the technology. Further, the present technology may employ any number of conventional techniques for transmitting data, sampling data, processing data, and the like.

Figure 1:
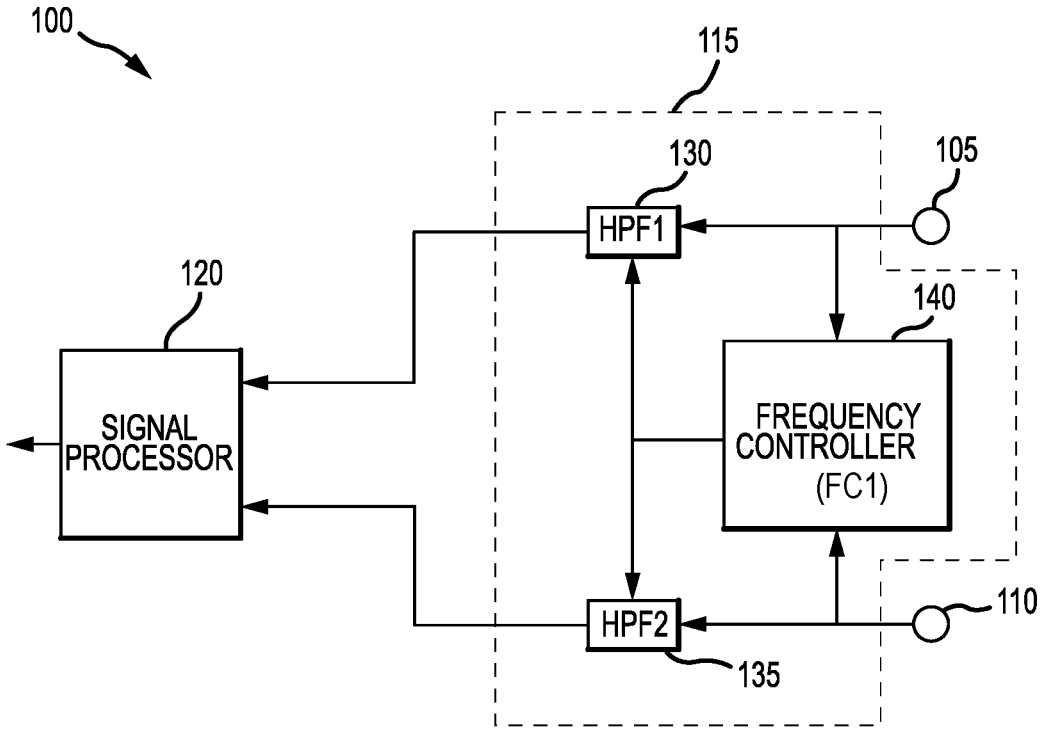
FIG. 1 is a block diagram of a microphone system in accordance with a first embodiment the present technology.
Figure 2:
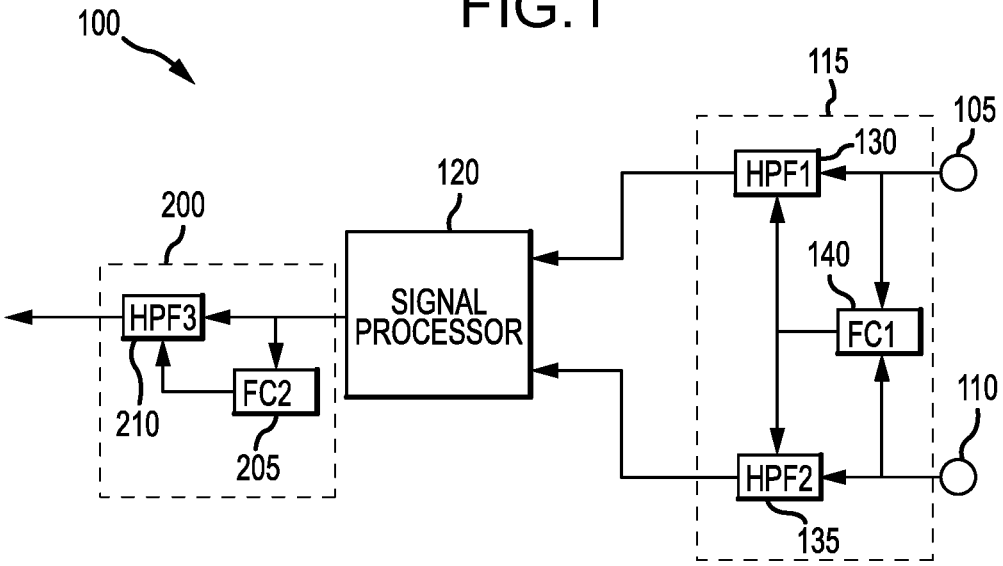
FIG. 2 is a block diagram of a microphone system in accordance with a second embodiment of the present technology.

Methods and apparatus for a microphone system according to various aspects of the present technology may operate in conjunction with any suitable electronic system, such as a voice/sound recording device, a cellular telephone, wearables, such as earbuds and headsets, medical hearing aids, and the like. Referring to FIGS. 1 and 2, various embodiments of a microphone system 100 may be incorporated into an electronic device, such as a cellular telephone. The microphone system 100 may be suitably configured to detect sound waves, convert the sound waves into an electrical signal, and process the electrical signal. The microphone system 100 may be further configured to detect wind noise in the signal, reduce or remove the wind noise, and/or determine characteristics of the wind noise.

According to various embodiments, the microphone system 100 may comprise a first microphone 105 (first mic) and a second microphone 110 (second mic) for detecting sound waves. The microphone system 100 may further comprise a first control circuit 115 to detect wind noise and remove or reduce the wind noise. The microphone system 100 may further comprise a signal processor 120 connected to the first control circuit 115 to process a target signal, such as speech.

The first and second microphones 105, 110 convert sound waves into an electrical signal (voltage or current). The first and second microphones 105, 110 are independent from each other, accordingly, the first microphone 105 generates a first electrical signal and the second microphone 110 generates a second electrical signal. The first and second microphones 105, 110 may comprise any circuit and/or system suitable for converting sound waves into an electrical signal. In the case of wind (i.e., air flow), the electrical signals may exhibit a wind noise component.

According to various embodiments, the first control circuit 115 may be configured to detect wind noise in at least one of the first microphone 105 and the second microphone 110 and selectively control the first and second electrical signals according to the detected wind noise. According to various embodiments, the first control circuit 115 may comprise a first frequency controller (FC1) 140, a first high pass filter (HPF1) 130, and a second high pass filter (HPF2) 135.

According to various embodiments, the first high pass filter 130 is connected to the first microphone 105 and the second high pass filter 135 is connected to the second microphone 110. Each high pass filter 130, 135 may be configured as a variable filter, wherein a cutoff frequency Fc of each filter may be varied within a particular range. According to an exemplary embodiment, the first high pass filter 130 receives the first electrical signal from the first microphone 105 and generates a first filtered signal according to a selected cutoff frequency. Similarly, the second high pass filter 135 receives the second electrical signal from the second microphone 110 and generates a second filtered signal according to a selected cutoff frequency. The selected cutoff frequency for the second high pass filter 135 may be different from or the same as the selected cutoff frequency for the first high pass filter 130.

According to various embodiments, the first high pass filter 130 may comprise a first high pass sub-filter HPF1A and a second high pass sub-filter HPF1B. Similarly, the second high pass filter 135 may also comprise a first high pass sub-filter HPF2A and a second high pass sub-filter HPF2B. In one embodiment, and referring to FIG. 3, each sub-filter HPF1A, HPF1B, HPF2A, HPF2B may be configured to have a fixed cutoff frequency. For example, the first sub-filters HPF1A, HPF2A may be set to have a lower cutoff frequency, such as 50 Hz, and the second sub-filters HPF1B, HPF2B may be set to have a higher cutoff frequency, such as 300 Hz.

Figure 4:
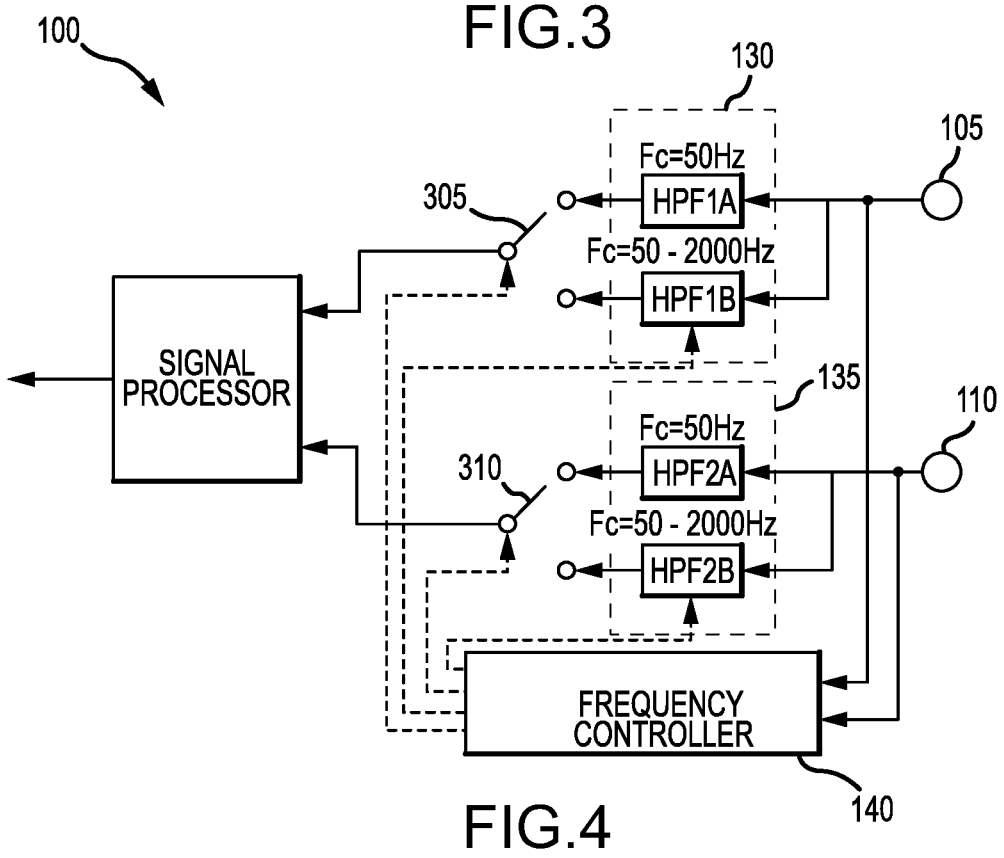
FIG. 4 is a block diagram of a microphone system with variable high pass filters in accordance with various embodiments of the present technology.

In an alternative embodiment, and referring to FIG. 4, at least one of the sub-filters for each high pass filter 130, 135 may be configurable and provide a range of cutoff frequencies, while at least one of the sub-filters has a fixed cutoff frequency. According to an exemplary embodiment, a lower cutoff frequency value may be the fixed value, while the higher cutoff frequency value may be configurable. For example, in the present embodiment, the second sub-filters HPF1B, HPF2B are able to provide a cutoff frequency range of 50 to 2000 Hz, while each the first sub-filters HPF1A, HPF2A have a fixed cutoff frequency, such as 50 Hz. Accordingly, the cutoff frequency for the second sub-filters HPF1B, HPF2B may be selected according to a desired cutoff frequency.

Figure 3:
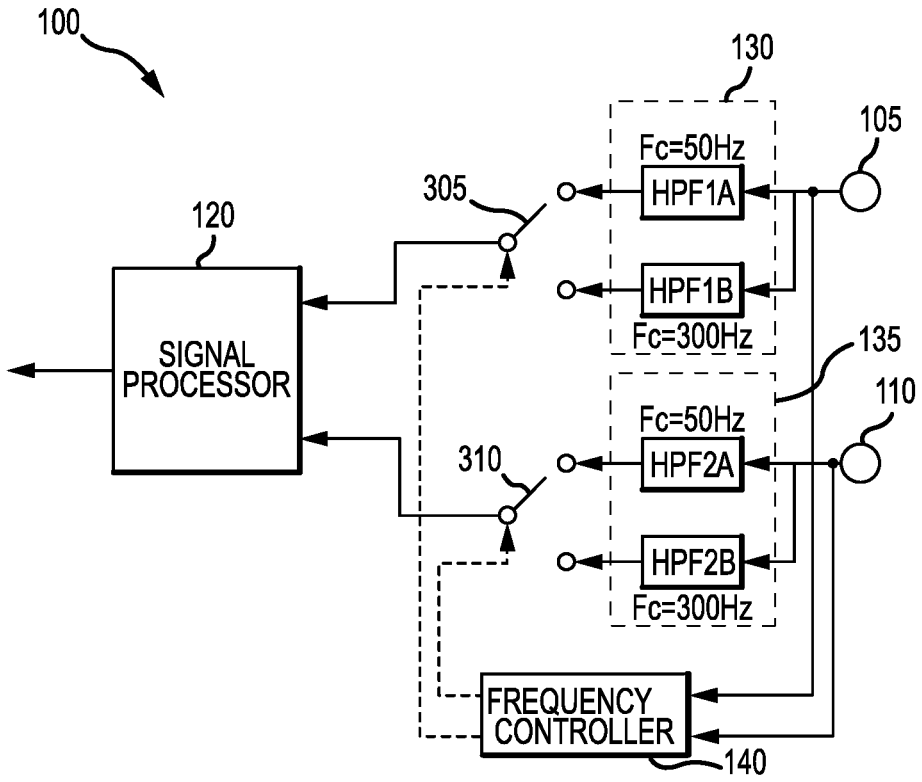
FIG. 3 is a block diagram of a microphone system with variable high pass filters in accordance with various embodiments of the present technology.

According to various embodiments, and referring to FIGS. 3 and 4, the microphone system 100 may further comprise a first switch 305 connected between the signal processor 120 and the first high pass filter 130 and configured to selectively transmit the first filtered signal from the first high pass filter 130 to the signal processor 120. The microphone system 100 may further comprise a second switch 310 connected between the signal processor 120 and the second high pass filter 135 and configured to selectively transmit the second filtered signal from the second high pass filter 135 to the signal processor 120.

Each of the first and second switches 305, 310 may be configured to switch between a first position and a second position. When the first switch 305 is in the first position, the first switch 305 may connect a low cutoff frequency sub-filter, such as HPF1A, to the signal processor 120. When the first switch 305 is in the second position, the first switch 305 may connect a high cutoff frequency sub-filter, such as HPF1B, to the signal processor 120.

Similarly, when the second switch 310 is in the first position, the second switch 310 may connect a low cutoff frequency sub-filter, such as HPF2A, to the signal processor 120. When the second switch 310 is in the second position, the second switch 310 may connect a high cutoff frequency sub-filter such as HPF2B, to the signal processor 120.

Each switch 305, 310 may comprise any circuit and/or device suitable for enabling and disabling an electrical connection. For example, each switch 305, 310 may comprise one or more transistors, an analog switch, or the like.

The first frequency controller 140 may be connected to each microphone 105, 110 and configured to detect a presence of wind noise in a signal according to various signal components in the first and second electrical signals. In general, wind noise has many signal characteristics that are different from speech, such as power, energy, frequency, pitch, and the like. For example, the first frequency controller 140 may be configured to measure a frequency, an amplitude, an energy, and/or a power of the first and second electrical signals and determine whether the signals contain or otherwise correspond to wind noise.

The power of a signal is defined as an average of a plurality of amplitudes squared over a period of time.

$$\text{(i.e., } P = \frac{1}{T}\sum_{t=1}^{T} A^2(t),$$

where A is amplitude as a function of time t). The energy of a signal is defined as the squared amplitude (i.e., $E=A^2$, where A is the amplitude).

In one embodiment, the first frequency controller 140 may evaluate whether a signal is wind noise or speech by performing linear prediction analysis. Because voice speech is synthesized as a resonance of vocal tract, linear prediction analysis works well for voice speech. On the other hand, since wind noise is a random signal that occurs when the air (wind) directly beats or flows over the microphone, linear prediction analysis does not work well. Accordingly, we can distinguish between wind noise and speech signals by using linear prediction analysis.

Alternatively or in addition, the first frequency controller 140 may evaluate whether a signal contains or corresponds to wind noise and/or speech by calculating a cross-correlation value C between the first and second electrical signals by using following formula.

$$C(\tau) = \frac{\frac{1}{(N+1)}\sum_{t=0}^{N} f_1(t)\cdot f_2(t+\tau)}{\sqrt{\frac{1}{(N+1)}\sum_{t=0}^{N} f_1(t)\cdot f_1(t)}\cdot\sqrt{\frac{1}{(N+1)}\sum_{t=0}^{N} f_2(t+\tau)\cdot f_2(t+\tau)}}$$

In this formula, $f_1$ is a digital signal of the first electrical signal converted by an analog-to-digital converter (not shown), $f_2$ is a digital signal of the second electrical signal converted by the analog-to-digital converter. For example, the first and second electrical signals may be sampled at a rate of 16 k Hz, with a length of 16 bits. In this formula, $f_1(t)$ is a digital value as a function of time, where t is a sampled time, $f_2(t+\tau)$ is a digital value as a function of time, where t is the sampled time and $\tau$ is a time delay. In general, speech is captured by each microphone 105, 110 as a sound wave and signals that contain only speech will have a high cross-correlation value C. In contrast, wind noise is not a sound wave, but rather a random signal, so signals that contain wind noise will have a low cross-correlation value C.

The frequency controller 140 may be further configured to compare the computed cross-correlation value C to a predetermined threshold value. The first frequency controller 140 may determine that wind noise exists if the cross-correlation value C is less than the predetermined threshold value. The first frequency controller 140 may determine that wind noise does not exist if the cross-correlation value C is greater than or equal to the predetermined threshold value. The first frequency controller 140 may then selectively operate the first and second high pass filters 305, 310 according to whether wind noise was detected and the energy and/or power of the detected wind noise. The predetermined threshold value may be selected based on the particular application, system, desired sensitivity, and the like.

Alternatively or in addition, the first frequency controller 140 may evaluate whether a signal contains or corresponds to wind noise and/or speech by performing pitch estimation. Voiced speech signals are quasi-stationary while wind noise is non-stationary. Therefore, the variance of a pitch estimate would be large for wind noise and small for speech signals.

Figure 5:
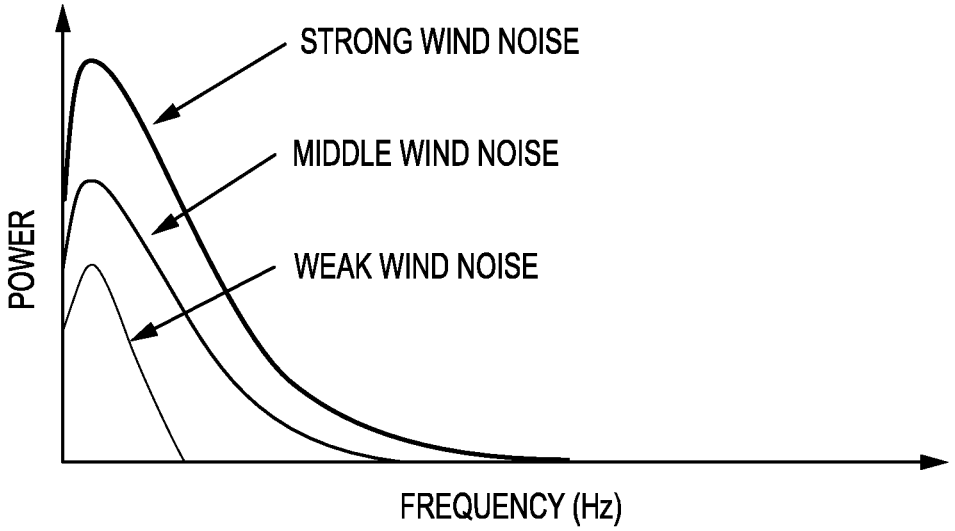
FIG. 5 illustrates power curves for weak wind noise, intermediate wind noise, and strong wind noise.

After the first frequency controller 140 has detected wind noise in the signal (either the first or second electrical signals), the first frequency controller 140 may be configured to compute or estimate a strength (i.e., power) of the detected wind noise. For example, and referring to FIG. 5, weak wind noise has a lower frequency range and lower power compared to an intermediate wind noise, and the strong wind noise has a higher frequency range and higher power compared to the intermediate wind noise. The various frequency ranges and/or power may be used to determine the cutoff frequencies for the high pass filters 130, 135.

The first frequency controller 140 may utilize the frequency to selectively activate and/or set the cutoff frequency for each of the first and second high pass filters 130, 135 according to whether the first frequency controller 140 detected wind noise and the frequency, amplitude, energy, and/or the power information extracted from the first and second electrical signals. For example, the first frequency controller 140 may be configured to generate a plurality of switch signals to control the first and second switches 305, 310 based on whether wind noise was detected.

According to various embodiments, the first frequency controller 140 may be communicatively coupled to the first and second switches 305, 310 and selectively operate the first and second switches 305, 310. For example, the first frequency controller 140 may turn the switch ON or OFF (in the case of a transistor switch), or change the position of the switch from the first position to the second position (or visa versa) according to the desired cutoff frequency. For example, when no wind noise is detected, the first position corresponding to a lower frequency, such as 50 Hz, may be selected. If wind noise is detected, the second position corresponding to a higher frequency, such as 300 Hz, may be selected.

The first frequency controller 140 may be further communicatively coupled to each of the first and second high pass filters 130, 135 to selectively control the cutoff frequency for each high pass filter 130, 135 according to the amplitude, energy, and/or power of the first and second electrical signals. For example, the first frequency controller 140 may be configured to generate a first select signal, which corresponds to a particular cutoff frequency, and transmit the first select signal to at least one of the first and second high pass filters 130, 135 to selectively control the cutoff frequency for the respective high pass filter.

Referring to FIG. 4, in a case where each of the first and second high pass filters 305, 310 comprise the variable sub-filter (e.g., HP1B, HPF2B), the first frequency controller 140 may transmit the first select signal to at least one of the variable sub-filters, wherein the first select signal corresponds to one cutoff frequency from the range of cutoff frequencies.

Referring to FIGS. 8-11, the first frequency controller 140 may further select and control the cutoff frequencies of the first and second high pass filters 130, 135 according to the direction of the wind. For example, in a case where no wind is detected (FIG. 8), the first frequency controller 140 may select a lower cutoff frequency value for both the first and second high pass filters 130, 135. For example, the first frequency controller 140 may set the cutoff frequency for both the first and second high pass filters 130, 135 to 50 Hz.

In a case where the wind reaches the first microphone 105 before reaching the second microphone 110 or wind noise of the first microphone 105 is stronger than the wind noise of the second microphone 110 (FIG. 9), the first frequency controller 140 may measure a higher amplitude (and higher power) for the first electrical signal and a lower amplitude (and lower power) for the second electrical signal. In the present case, the first frequency controller 140 may select a higher cutoff frequency value for the first high pass filter 130 than that for the second high pass filter 135. For example, the first frequency controller 140 may set the cutoff frequency for the first high pass filter 130 to 1500 Hz and set the cutoff frequency for the second high pass filter 135 to 300 Hz.

In a case where the wind reaches the first microphone 105 and the second microphone 110 at the same time or the strength of the wind noise of the first microphone 105 is as same as the second microphone 110 (FIG. 10), the first frequency controller 140 may measure the same amplitude (and power) for both the first and second electrical signals. In the present case, the first frequency controller 140 may select the same cutoff frequency values for both the first and second high pass filters 130, 135. For example, the first frequency controller 140 may set the cutoff frequency for both the first and second high pass filters 130, 135 to 1000 Hz.

In a case where the wind reaches the second microphone 110 before reaching the first microphone 105 or the wind noise of the first microphone 105 is weaker than the wind noise of the second microphone 110 (FIG. 11), the first frequency controller 140 may measure a higher amplitude (and higher power) for the second electrical signal and a lower amplitude (and lower power) for the first electrical signal. In the present case, the first frequency controller 140 may select a higher cutoff frequency value for the second high pass filter 135 than that for the first high pass filter 130. For example, the first frequency controller 140 may set the cutoff frequency for the first high pass filter 130 to 300 Hz and set the cutoff frequency for the second high pass filter 135 to 1500 Hz.

According to various embodiments, the first frequency controller 140 may comprise any circuits and/or systems suitable for performing computations, such as the cross-correlation value C, the power P, and the like. The first frequency controller 140 may further comprise a counter (not shown) for counting and/or storing a count value. The first frequency controller 140 may further comprise a memory (not shown) to store various values, such as calculated values and the predetermined threshold value.

The signal processor 120 may comprise any suitable methods or techniques for analyzing multiple sound waves, such as a device and/or system capable of beamforming (i.e., a beamformer). According to various embodiments, the signal processor 120 may perform subtraction-type beamforming or any other type of beamforming.

According to various embodiments, the signal processor 120 may receive the first and second filtered signals via the first and second switches 305, 310. The signal processor 120 may process the first and second filtered signals according to the beamforming technique to control a phase and a relative amplitude (or energy, or power) of the first and second filtered signals. The signal processor 120 may comprise any circuit and/or system suitable for performing desired processing of the first and second filtered signals. For example, the signal processor 120 may be realized using hardware, software, or a combination thereof.

According to a second embodiment, and referring to FIG. 2, the microphone system 100 may comprise a second control circuit 200 connected to an output terminal of the signal processor 120 to further process the electrical signals. For example, the second control circuit 200 may comprise a third high pass filter 210 and a second frequency controller (FC2) 205 configured to selectively control a cutoff frequency of the third high pass filter 210 according to an output signal of the signal processor 120.

According to the present embodiment, the third high pass filter 210 receives the output signal from the signal processor 120 and a second select signal from the second frequency controller 205. The second frequency controller 205 receives the output signal from the signal processor 120 and determines a desired cutoff frequency according to various characteristics (e.g. frequency, amplitude, energy, power) of the output signal. The second frequency controller 205 may generate the second select signal that corresponds to a desired cutoff frequency and transmit the second select signal to the third high pass filter 210. The third high pass filter 210 may respond to the second select signal by attenuating the output signal according to the desired cutoff frequency for the third high pass filter 210.

According to various embodiments, the microphone system 100 operates to remove or reduce wind noise in a signal while performing beamforming on the signal. According to various embodiments, the beamforming process is not disabled when wind noise is detected. The microphone system 100 detects wind noise and selects the cutoff frequency based on the wind noise characteristics, such as the frequency, energy, amplitude and/or power of the wind noise signal component.

Figure 6:
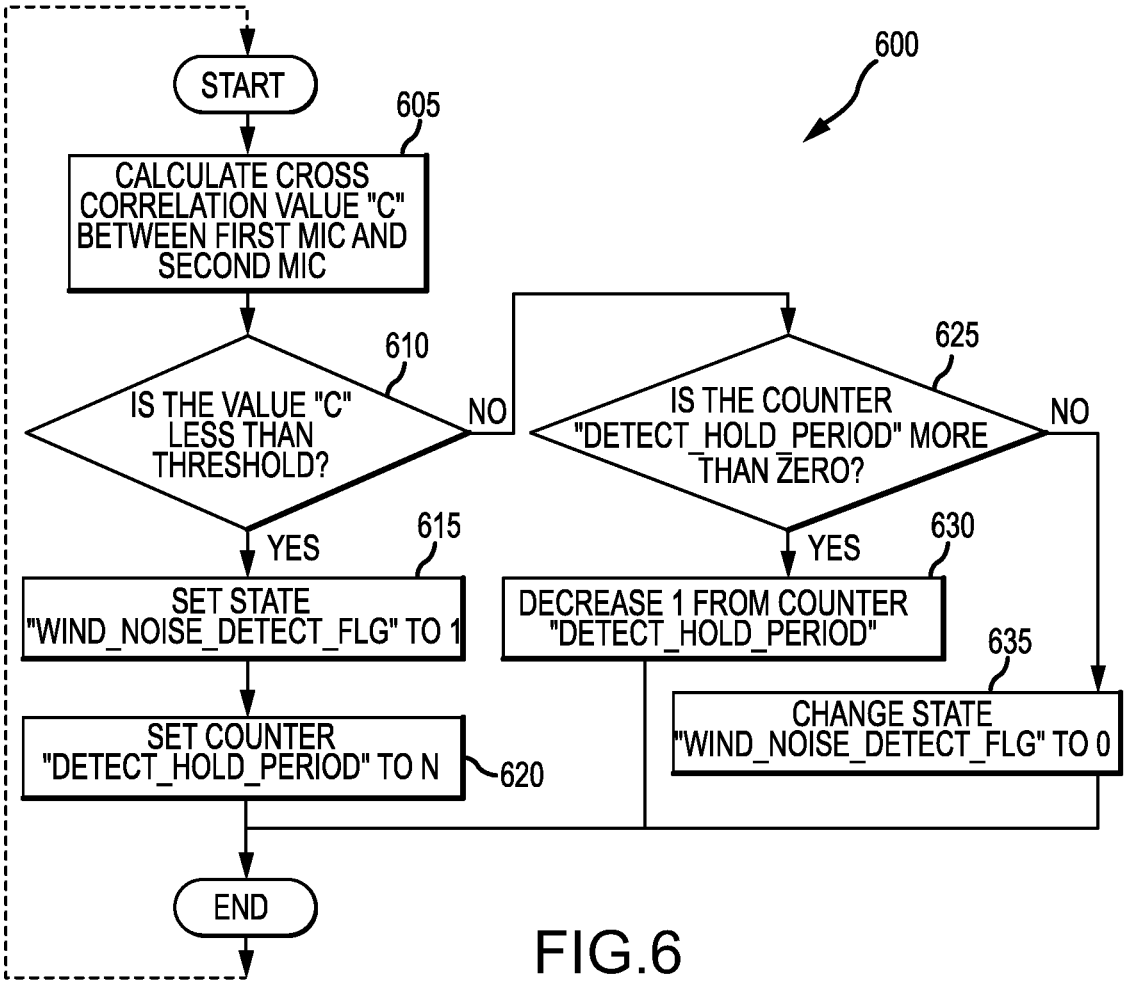
FIG. 6 is a flow chart for detecting wind noise in accordance with various embodiments of the present technology.

Referring to FIG. 6, in an exemplary operation, the first frequency controller 140 determines whether or not wind noise exists (600). The first frequency controller 140 calculates the cross-correlation value C between the first microphone 105 and the second microphone 110 according to the formula above (605). The first frequency controller 140 then determines if the cross-correlation value C is less than a predetermined threshold (610). If the cross-correlation value C is less than the predetermined threshold value, then a "wind_noise_detect_flg" is set to 1 (where 1 means that wind noise was detected and a 0 means that no wind noise was detected) (615) and a counter configured to store a "detect_hold_period" value is set to N (620), where N is a predetermined value, but varies based on the particular application.

If the cross-correlation value C is not less than the predetermined threshold value, then the first frequency controller 140 determines if the counter "detect_hold_period" value is greater than zero (625). If the "detect_hold_period" value is greater than zero, then the "detect_hold_period" value is decreased by 1 (630). If the "detect_hold_period" value is not greater than zero, then the "wind_noise_detect_flg" is set to 0 (635). The process may be repeated periodically, for example every 10 ms.

Figure 7:
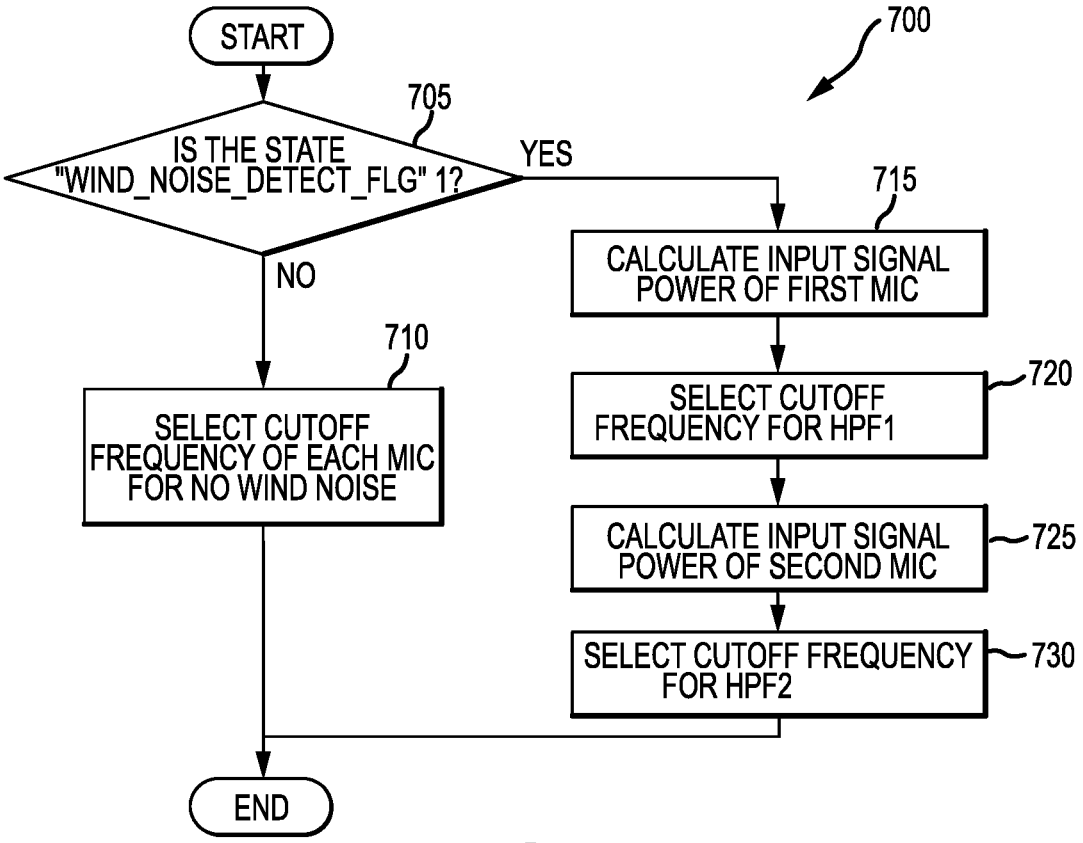
FIG. 7 is a flow chart for setting a cutoff frequency of the variable high pass filters in accordance various embodiments of the present technology.
Figure 8:
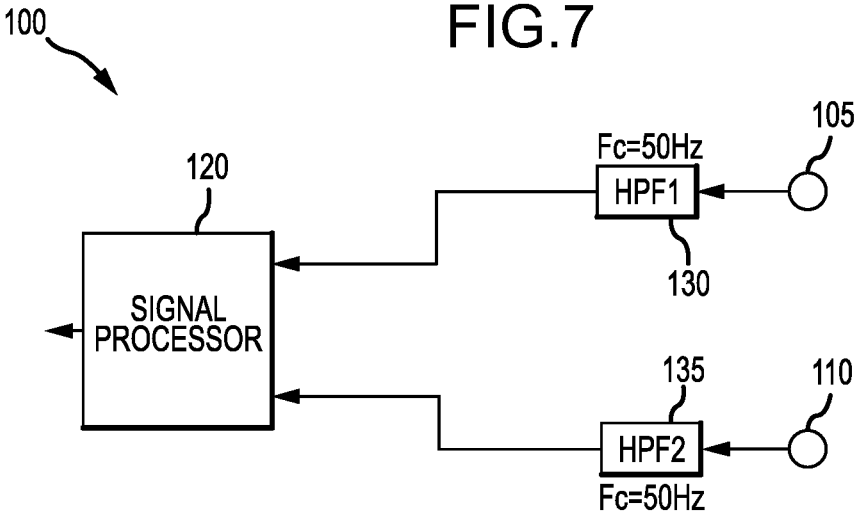
FIG. 8 illustrates example cutoff frequencies of the variable high pass filters when no wind or wind noise is detected in accordance with various embodiments of the present technology.
Figure 9:
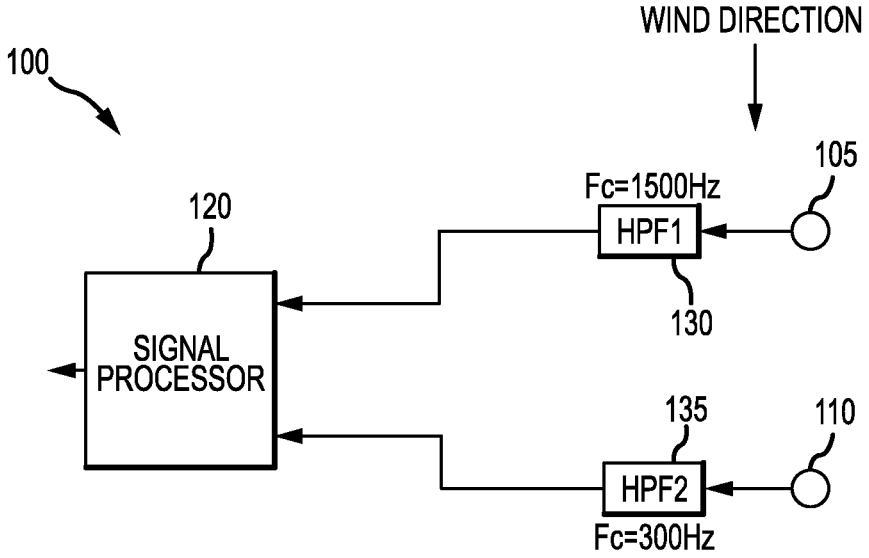
FIG. 9 illustrates example cutoff frequencies of the variable high pass filters when wind is detected from a first direction in accordance with various embodiments of the present technology.
Figure 10:
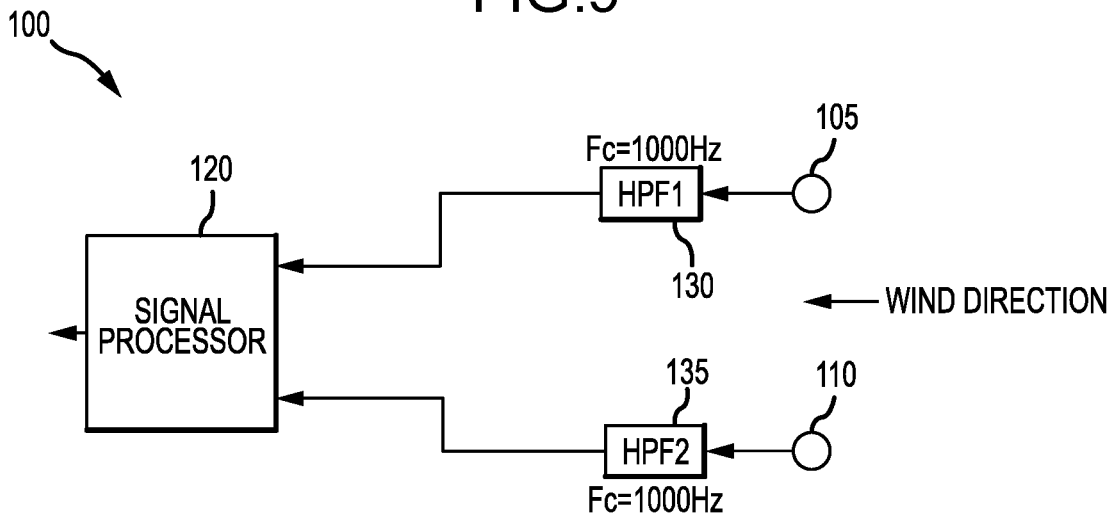
FIG. 10 illustrates example cutoff frequencies of the high pass filters when the wind is detected from a second direction in accordance with various embodiments of the present technology.
Figure 11:
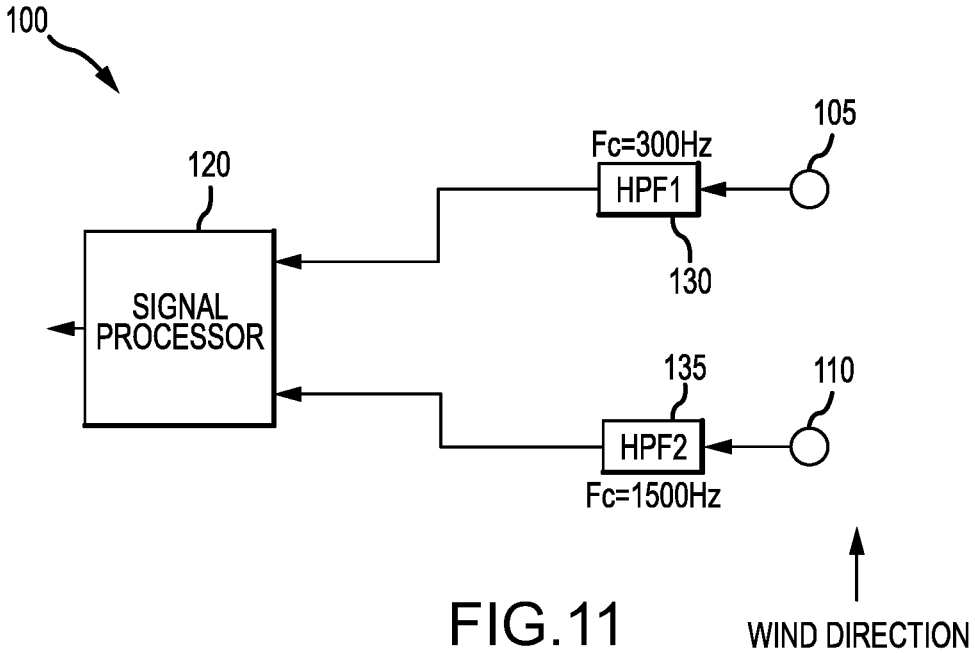
FIG. 11 illustrates example cutoff frequencies of the variable high pass filters when the wind is detected from a third direction in accordance with various embodiments of the present technology.

Referring to FIG. 7, the first frequency controller 140 selects an appropriate cutoff frequency for the first and second high pass filters 130, 135 (700). In an exemplary operation, if the "wind_noise_detect_flg" is set to 1 (705), then this means that wind noise was detected and the first frequency controller 140 then calculates a power of the first electrical signal from the first microphone 105 (715) and selects a cutoff frequency for the first pass filter 130 according to the calculated power (720). The first frequency controller 140 then calculates a power of the second electrical signal from the second microphone 110 (725) and selects a cutoff frequency for the second high pass filter 135 according to the calculated power (730). If the "wind_noise_detect_flg" is not set to 1 (i.e., the "wind_noise_detect_flg" is set to 0) (705), then the first frequency controller 140 selects a cutoff frequency for each high pass filter 130, 135 that corresponds to no wind noise (i.e., a lower cutoff frequency is selected) (710).

Figure 12:
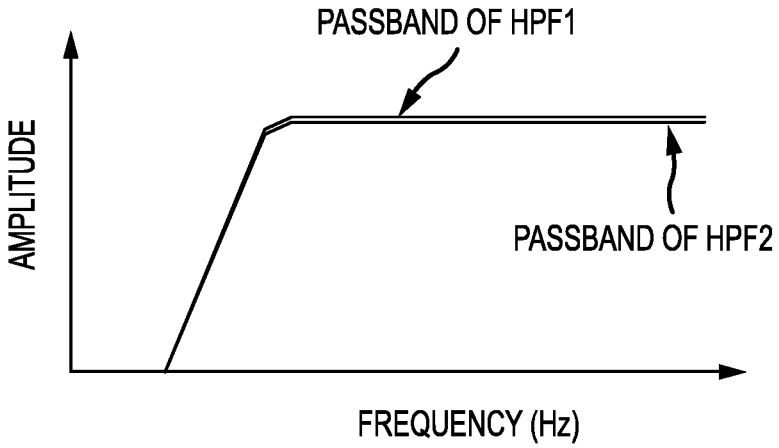
FIG. 12 is a frequency spectrum diagram illustrating a passband of the first high pass filter and a passband of the second high pass filter when the cutoff frequencies for the first high pass filter and the second high pass filter are equal in accordance with various embodiments of the present technology.

Referring to FIGS. 12-14, when the first high pass filter 130 and the second high pass filter 135 have the same cutoff frequency, the passband of each is also the same and the beamforming function can create uni-directional characteristics in the passband (FIG. 12). When the second high pass filter 135 has a higher cutoff frequency than the first high pass filter 130 (FIG. 13), then the beamforming function can create uni-directional characteristics in the passband of the second high pass filter 135. However, the beamforming function cannot create uni-directional characteristics at the frequency lower than the passband of the second high pass filter 135 because there is only a single microphone input. This frequency band has omni-directional characteristics. When the first high pass filter 130 has a higher cutoff frequency than the second high pass filter 135 (FIG. 14), the beamforming function can create uni-directional characteristics in the passband of the first high pass filter 130. However, the beamforming function cannot create unidirectional characteristics at the frequency lower than the passband of first high pass filter 130 because there is only a single microphone input. This frequency band has omnidirectional characteristics.

In the foregoing description, the technology has been described with reference to specific exemplary embodiments. The particular implementations shown and described are illustrative of the technology and its best mode and are not intended to otherwise limit the scope of the present technology in any way. Indeed, for the sake of brevity, conventional manufacturing, connection, preparation, and other functional aspects of the method and system may not be described in detail. Furthermore, the connecting lines shown in the various figures are intended to represent exemplary functional relationships and/or steps between the various elements. Many alternative or additional functional relationships or physical connections may be present in a practical system.

The technology has been described with reference to specific exemplary embodiments. Various modifications and changes, however, may be made without departing from the scope of the present technology. The description and figures are to be regarded in an illustrative manner, rather than a restrictive one and all such modifications are intended to be included within the scope of the present technology. Accordingly, the scope of the technology should be determined by the generic embodiments described and their legal equivalents rather than by merely the specific examples described above. For example, the steps recited in any method or process embodiment may be executed in any order, unless otherwise expressly specified, and are not limited to the explicit order presented in the specific examples. Additionally, the components and/or elements recited in any apparatus embodiment may be assembled or otherwise operationally configured in a variety of permutations to produce substantially the same result as the present technology and are accordingly not limited to the specific configuration recited in the specific examples.

Benefits, other advantages and solutions to problems have been described above with regard to particular embodiments. Any benefit, advantage, solution to problems or any element that may cause any particular benefit, advantage or solution to occur or to become more pronounced, however, is not to be construed as a critical, required or essential feature or component.

The terms "comprises", "comprising", or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present technology, in addition to those not specifically recited, may be varied or otherwise particularly adapted to specific environments, manufacturing specifications, design parameters or other operating requirements without departing from the general principles of the same.

The present technology has been described above with reference to an exemplary embodiment. However, changes and modifications may be made to the exemplary embodiment without departing from the scope of the present technology. These and other changes or modifications are intended to be included within the scope of the present technology, as expressed in the following claims.

The invention claimed is:

1. A control circuit connected to a first microphone and a second microphone, comprising:
- a first high pass filter connected to the first microphone;
- a second high pass filter connected to the second microphone; and
- a frequency controller connected to the first and second microphones and configured to:
  - detect wind on at least one of the first and second microphones;
  - determine a direction of the wind relative to the first and second microphones;
  - select a first cutoff frequency for the first high pass filter based on the direction of the wind; and
  - select a second cutoff frequency for the second high pass filter based on the direction of the wind;
  - wherein:
    - the first cutoff frequency is greater than the second cutoff frequency if the wind has a first direction; and
    - the first cutoff frequency is less than the second cutoff frequency if the wind has a second direction.

2. The control circuit according to claim 1, wherein the frequency controller further selects the first and second cutoff frequencies based on a frequency of the detected wind.

3. The control circuit according to claim 1, wherein:
- the first microphone generates a first electrical signal;
- the second microphone generates a second electrical signal; and
- wind generates a wind noise signal component in at least one the first and second electrical signals.

4. The control circuit according to claim 3, wherein the frequency controller is further configured to compute a cross-correlation value between the first and second electrical signals to determine whether at least one of the signals contains the wind noise signal component.

5. The control circuit according to claim 1, wherein the first high pass filter comprises:
- a first sub-filter with a first fixed cutoff frequency; and
- a second sub-filter with a second fixed cutoff frequency.

6. The control circuit according to claim 1, wherein the second high pass filter comprises:
- a first sub-filter with a first fixed cutoff frequency; and
- a second sub-filter with a second fixed cutoff frequency.

7. The control circuit according to claim 1, wherein the first high pass filter comprises:
- a first sub-filter with a fixed cutoff frequency; and
- a second sub-filter with a variable cutoff frequency.

8. The control circuit according to claim 1, wherein the second high pass filter comprises:
- a first sub-filter with a fixed cutoff frequency; and
- a second sub-filter with a variable cutoff frequency.

9. The control circuit according to claim 1, wherein the control circuit further comprises:
- a first switch connected to an output terminal of the first high pass filter; and
- a second switch connected to an output terminal of the second high pass filter;
- wherein the frequency controller is configured to operate each of the first and second switches according to a frequency of the detected wind.

10. A method for attenuating wind noise, comprising:
- generating a first electrical signal;

generating a second electrical signal;

detecting wind noise in at least one of the first and second electrical signals;

selectively filtering the first and second electrical signals according to the detected wind noise, comprising:

applying a first cutoff frequency to the first electrical signal; and applying a second cutoff frequency to the second electrical signal;

processing the filtered first and second signals using a subtraction-type beamforming function to generate a processed signal; and selectively filtering the processed signal by applying a cutoff frequency to the processed signal based on a characteristic of the processed signal.

11. The method according to claim 10, wherein detecting wind noise comprises computing a cross-correlation value using the first and second electrical signals.

12. The method according to claim 10, further comprising measuring:

a first power of the first electrical signal; and a second power of the second electrical signal.

13. The method according to claim 12, wherein selectively filtering the first and second electrical signals comprises:

applying the first cutoff frequency to the first electrical signal according to the first power;

applying the second cutoff frequency to the second electrical signal according to the second power.

14. A system, comprising:

a first microphone configured to generate a first electrical signal;

a second microphone configured to generate a second electrical signal; and a control circuit connected to the first and second microphones and comprising:

a first high pass filter configured to receive the first electrical signal;

a second high pass filter configured to receive the second electrical signal; and a first frequency controller configured to:

receive the first and second electrical signals;

compute a cross-correlation value using the first and second electrical signals;

select a first cutoff frequency for the first high pass filter according to the computed cross-correlation value; and select a second cutoff frequency for the second high pass filter according to the computed cross-correlation value;

a signal processor connected to an output terminal of the first high pass filter and an output terminal of the second high pass filter;

a third high pass filter connected to an output terminal of the signal processor; and a second frequency controller configured to select a third cutoff frequency for the third high pass filter according to an output signal of the signal processor.

15. The system according to claim 14, wherein the cross-correlation value indicates whether wind noise exists in at least one of the first and second electrical signals.

16. The system according to claim 14, wherein the first frequency controller is further configured to measure:

a power of the first electrical signal; and a power of the second electrical signal.

17. The system according to claim 16, wherein the first frequency controller:

selects the first cutoff frequency based on the power of the first electrical signal; and selects the second cutoff frequency based on the power of the second electrical signal.

18. The system according to claim 14, wherein:

the first high pass filter comprises a sub-filter with a first fixed cutoff frequency; and the second high pass filter comprises a sub-filter with a second fixed cutoff frequency.

19. The system according to claim 14, wherein each of the first and second high pass filters comprises a sub-filter with a variable cutoff frequency in a range of 50 Hz to 2000 Hz.

* * * * *